United States Patent [19]

Grob et al.

[11] Patent Number: 4,721,536

[45] Date of Patent: Jan. 26, 1988

[54] METHOD FOR MAKING STEEL TUBES OR PIPES OF INCREASED ACIDIC GAS RESISTANCE

[75] Inventors: Heinz Grob, Dortmund; Friedrich-Otto Koch, Unna-Massen; Adolf Peeck, Hamm; Werner Wennemann, Dortmund, all of Fed. Rep. of Germany

[73] Assignee: Hoesch Aktiengesellschaft, Fed. Rep. of Germany

[21] Appl. No.: 872,405

[22] Filed: Jun. 10, 1986

[30] Foreign Application Priority Data

Jun. 10, 1985 [DE] Fed. Rep. of Germany ..... 3520702

[51] Int. Cl.[4] ..... C21D 8/10

[52] U.S. Cl. ..... 148/12 F; 148/127; 148/150; 148/154

[58] Field of Search ..... 148/150, 154, 12 R, 148/12 F, 145, 127

[56] References Cited

U.S. PATENT DOCUMENTS

| | | | |
|---|---|---|---|
| 4,020,312 | 4/1977 | Araki et al. | 219/61 |
| 4,168,190 | 9/1979 | Eguchi et al. | 148/136 |
| 4,229,235 | 10/1980 | Matsuda et al. | 148/127 |
| 4,388,123 | 6/1983 | Murayama | 148/12 F |

FOREIGN PATENT DOCUMENTS

| | | | |
|---|---|---|---|
| 77529 | 5/1983 | Japan | 148/12 F |

*Primary Examiner*—Christopher W. Brody
*Attorney, Agent, or Firm*—McCormick, Paulding and Huber

[57] ABSTRACT

For increasing the resistance of steel pipes or tubes against acidic medium, by a combination of a heat treatment and the use of an alloyed steel, a compressure stress is built up on the side of the tubes or pipes facing the acidic medium, of up to 30% of the yield limit.

24 Claims, 12 Drawing Figures

Figure 1B:
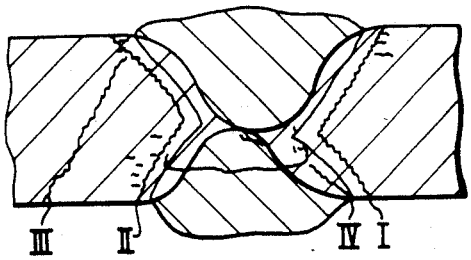

$$CSR = \frac{\Sigma a_i \cdot b_i}{A\ B} \qquad CLR = \frac{\Sigma a_i}{A} \qquad CTR = \frac{\Sigma b_i}{B}$$

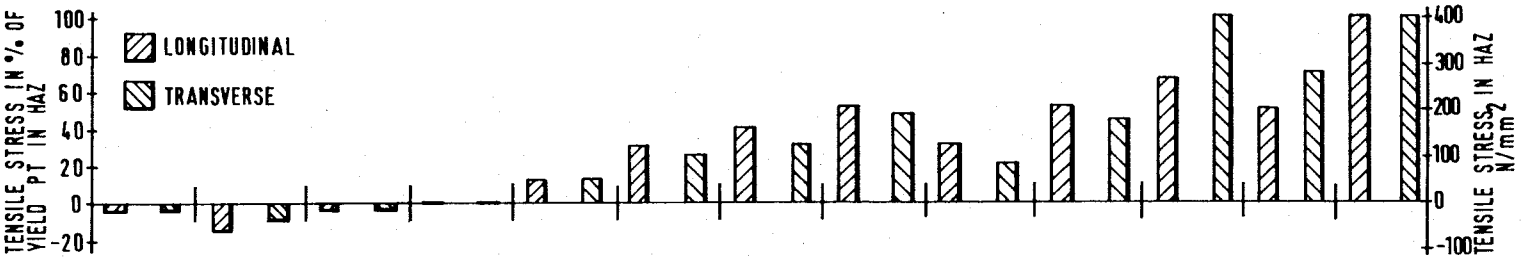

| Lfd. Nr. | N | M | L | K | I | H | G | F | E | D | C | B | A |
|---|---|---|---|---|---|---|---|---|---|---|---|---|---|
| PIPE-NR. | 6727 A2 | 6727 A1 | 6728 A | 6721 B | 6724 B 6728 C | 6728 B | 6724 A | 6726 B | 6722 A | 6726 A | 6724 C | 6723 A | 6725 6723 B |
| ROD / POWDER | S2 Ni1 UV 306 P | S2 Ni1 UV 306 P | S2 Ni1 UV 306 P | S2 Ni1 UV 306 P | S1Mo/S2 Ni1 UV 306 P | S2 Ni1 UV 306 P | S1 Mo UV 306 P | S1Mo UV 306 P | S2 Ni1 UV 306 P | S1 Mo UV 306 P | S1 Mo UV 306 P | S1 Mo UV 306 P | S1 Mo UV 306 P |
| CON-DITIONS | (P/A) · $V_M$ ≥10.000 $Wm^{-1}$ $sec^{-1}$ | | RING INDUCTOR Q + T | RING INDUCTOR Q + T | RING INDUCTOR | RING INDUCTOR | RING INDUCTOR | RING INDUCTOR | RING INDUCTOR | RING INDUCTOR | PARTIALLY ANNEALED (AUTOGEN) | 0,1 % exp. | AS WELDED |
| Temp. | 600°C/$H_2O$ INTERIOR | 600°C/$H_2O$ INTERIOR | 950/640°C | 940/600°C | 700°C/AIR | 640°C/AIR | 600°C/AIR | 600°C/AIR | 700°C/$H_2O$ EXTERIOR | 600°C/$H_2O$ EXTERIOR | 600°C/$H_2O$ INTERIOR | % | % |
| SEAM FEED RATE $V_M$ | 0,45m/min | 0,45m/min | 0,092m/min | 0,092m/min | 0,170 m/min 0,093 | 0,093m/min | 0,17m/min | 0,093m/min | 0,093m/min | 0,093m/min | 0,1m/min | % | % |
| EXAMI-NATION | CRACK FREE | CRACK FREE | CRACK FREE | CRACK FREE | CRACKS IN THE WELD | CRACKS IN THE WELD | CRACK FREE | CRACK FREE | CRACKS | CRACKS | CRACKS | CRACKS | CRACKS |

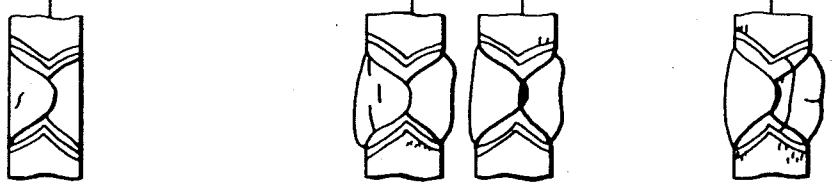

Fig. 4

CHEMICAL COMPOSITION IN % BY WT.
| Charge | BAR | RING | C | Si | Mn | P | S | Al | N | Cu | Ni | Nb | $O_2$ | Ca |
|---|---|---|---|---|---|---|---|---|---|---|---|---|---|---|
| | | | 0,08 | 0,39 | 0,80 | 0,010 | 0,0010 | 0,044 | 0,0049 | 0,25 | 0,19 | 0,047 | | |
| | 5 | VI | 0,09 | 0,37 | 0,80 | 0,010 | 0,0011 | 0,049 | 0,0050 | 0,26 | 0,20 | 0,040 | 0,002 | 0,00192 |
| | 6 | VII | 0,09 | 0,38 | 0,80 | 0,010 | 0,0011 | 0,049 | 0,0050 | 0,26 | 0,20 | 0,040 | 0,002 | 0,00140 |
MECH. PROPERTIES OF PIPE, TRANSVERSE
| RING | PIPE DIMENSIONS | BASE MATERIAL STARTING STATE Rp | MPa | Rm | SEAM SEAM ANNEALED Rm [MPa] | BASE MATERIAL FULLY ANNEALED Rp | MPa | Rm |
|---|---|---|---|---|---|---|---|---|
| VI | 219,1mm x 9,52mm | 455 | | 545 | 553 | 347 | | 485 |
| VII | 329,9 mm x 9,52 mm | 423 | | 547 | 563 | 367 | | 464 |
STARTING STATE
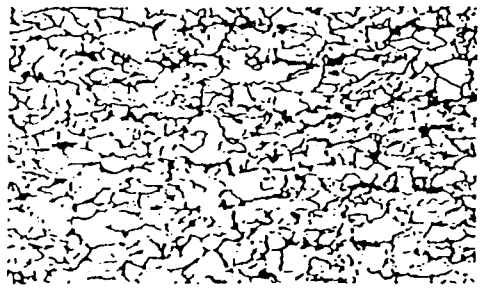
500:1
ANNEALED
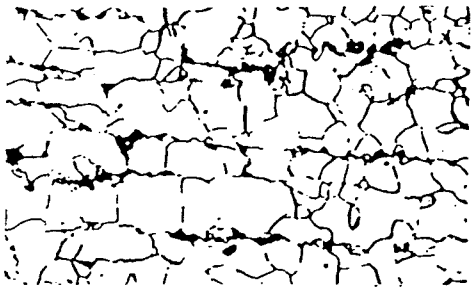
500:1
Fig. 5

CHEMICAL COMPOSITION IN % BY WT.

| | C | Si | Mn | P | S | Al | N | O | V | Nb | Ca |
|---|---|---|---|---|---|---|---|---|---|---|---|
| DESIRED | 0,07 -0,09 | 0,35 -0,45 | 0,80 -0,95 | ≤0,010 | 0,001 | 0,015 0 035 | ≤0,007 | 0,001 | 0,040 -0,060 | 0,030 -0,040 | 0,0020 -0,0030 |
| FUZED SAMPLE | 0,09 0,09 | 0,40 0,40 | 0,87 0,86 | 0,008 0,010 | 0,0012 0,0014 | 0,040 0,044 | 0,0072 0,0069 | 0,001 | 0,050 0,050 | 0,037 0,040 | 0,0023 0,00174 |

MECH. PROPERTIES

| RING | HT = HASPEL TEMP. [°C] | DIM. [mm] | RING Rp [MPa] | RING Rm | PIPE BASE MAT., PIPE CIRCUM. Rp [MPa] | PIPE BASE MAT., PIPE CIRCUM. Rm | REQUIREMENTS ACCORDING TO API - 5L *2 Rp [MPa] | REQUIREMENTS ACCORDING TO API - 5L *2 Rm | PURITY ACCORDING TO *1 SEP 1570 K1 | PURITY ACCORDING TO *1 SEP 1570 K4 |
|---|---|---|---|---|---|---|---|---|---|---|
| IV | 620 | 620 ϕ x 10 | 470 | 518 | 423 - 446 | 520 - 534 | ≥ 413 | ≥ 517 | 1,2 | 0 |
| V | 545 | " | 498 | 551 | 420 | 547 | | | | |

HT 620°C

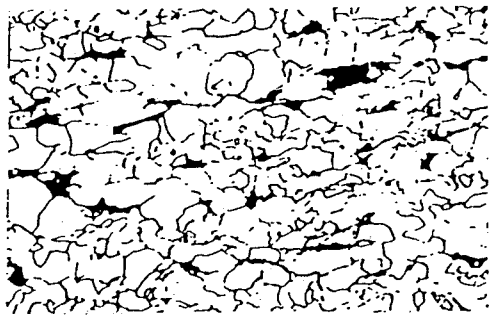

500:1

HT 545°C

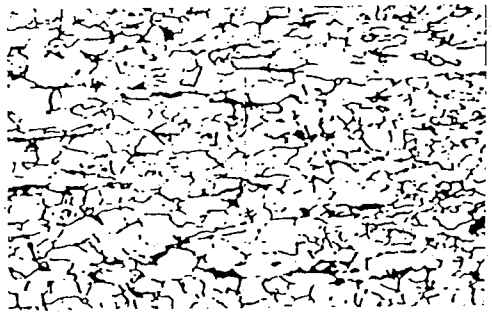

500:1

* 1 SEP STEEL-IRON-TEST 1570

Fig.6

*2 API American Petroleum Institute

| PIPE-NR. | | TEST LOCATION IN COIL | EXAMINING DIRECTION | Rp MPa | Rm MPa | Rp/Rm | ELONGATION * API % |
|---|---|---|---|---|---|---|---|
| REQUIREMENT FOR X46 | | | | 317 | 434 | | - |
| A I | 508mm x 12,7mm | BEGINNING | TRANSVERSE TO PIPE | 400 | 472 | 0,85 | 32,0 |
| A II | " | MIDDLE | " | 376 | 461 | 0,82 | 33,5 |
| A III | " | END | " | 388 | 458 | 0,85 | 35,0 |

CHEMICAL PROPERTIES

| C % | Si % | Mn % | P % | S % | Al % | N % | |
|---|---|---|---|---|---|---|---|
| 0,037 | 0,28 | 0,79 | 0,015 | 0,001 | 0,038 | 0,0062 | FUSION ANALYSIS |
| 0,04 | 0,28 | 0,82 | 0,11 | 0,002 | 0,040 | 0,0080 | SAMPLE ANALYSIS |

| Cu % | Cr % | Ni % | V % | Mo % | Ti % | Nb % | |
|---|---|---|---|---|---|---|---|
| 0,02 | 0,04 | 0,02 | - | - | - | 0,026 | FUSION ANALYSIS |
| 0,013 | 0,040 | 0,027 | 0,003 | 0,005 | 0,004 | 0,028 | SAMPLE ANALYSIS |

* API American Petroleum Institute

Fig. 7

METHOD FOR MAKING STEEL TUBES OR PIPES OF INCREASED ACIDIC GAS RESISTANCE

The invention relates to a method of making welded steel pipes which can be used for the transport of acidic gases and/or oils with compressive stresses present on the inner side facing the acidic gas and/or oil and the use of a steel.

In welded pipelines oils and gases are frequently conveyed which contain hydrogen sulfide (H2S) and are thus referred to as "acidic". The H2S-containing materials lead in the pipes to cracks which are referred to as "hydrogen-induced stress crack corrosion". A distinction is made between the so called HIC flaws (Hydrogen Induced Cracking ) and the SCC flaws (Stress Corrosion Cracking). Damage due to acidic gas and acidic oil has occurred in a great variety of countries as little as a few weeks after starting operation, the cracking occurring in particular near the weld seam in the lower portion of the pipe. This damage affects pipelines both with longitudinal welded seam and spiral welded seam.

It is known, cf. "Stahl und Eisen" 1984, p. 1357 to 1360, that for acidic gas lines a very low sulfur content and a high oxidic degree of purity are necessary and for this purpose in particular a ladlemetallurgical treatment, in particular a calcium treatment, in a ladle with basic lining is known. It is further known to thermomechanically roll a steel to obtain certain mechanical properties, in particular to obtain a well matched combination of strength and toughness properties, cf. "Stahl und Eisen" 1981, p. 483 to 491 and p. 593 to 600.

U.S. Pat. No. 3,992,231 discloses a method for making oilfield pipelines with improved acidic gas properties. According to this method from a steel having 0.28 to 0.42% C., 0.8 to 1.2% Cr, 0.6 to 1.0% Mo, 0.025 to 0.05% Nb, 0.4 to 1.0% Mn, 0.2 to 0.6% Si, the balance iron and the usual unavoidable impurities, firstly seamless pipes are made which after an austenitizing annealing are quenched. To produce a compressive stress on the tube inner side the seamless pipes are then heated for several hours to a temperature of 540° C. to beneath the transformation temperature, i.e. 690° C., and then the pipe inner wall rapidly quenched with water. The pipes made by this known method are typical oilfield pipes with a screw connection as can be made up to diameters of about 500 mm. Large pipes for pipelines cannot however be made by seamless methods. In addition, a steel of the composition specified results in lack of weldability in the field and furthermore the long heat treatment, for which correspondingly large heating furnaces are necessary, involves high technical and economic outlay.

Quite apart from this, the heat treatment provided reduces the tensile yield point of the pipe made so that high quality can only be achieved by appropriate additional measures, such as increased alloy additives of expensive alloying elements.

DE-OS No. 3 422 781 also discloses a method for heat treating an existing pipeline in which an induction coil placed round the pipeline and a coolant continuously flowing through the pipe bring about the temperature distribution across the wall thickness necessary to generate compressive stresses on the inner surface. The regulation of the temperature distribution is by mechanical change of the induction coil geometry (diameter and pitch) which in turn causes a change of the magnetic flux density. With this method in a stationary process in particular the connecting circular seams lying in a plane perpendicular to the pipe axis between two pipes are to be subjected to a heat treatment. This procedure, which is extremely discontinuous due to the respective buildup of a defined steady state condition in the region to be treated, does not permit a continuous treatment of a helical or axis-parallel seam of a welded individual pipe in particular during the production process.

In addition, the intended continuous internal passage of coolant in single pipe production is very complicated in practice as regards apparatus and involves a high consumption of coolant and high power consumption.

A further disadvantage is that with continuous coolant flow in the steady state condition apart from the magnetic flux density no further control possibility is available for optimizing the heat treatment.

Further known from DE-PS No. 2 716 081 is the use of a controlled steel having a yield point of at least 40 HB and consisting of 0.01 to 0.13% carbon, 0.1 to 1.0% silicon, 0.7 to 2.0% manganese, at the most 0.1% total aluminium, 0.004 to 0.03% titanium, 0.001 to 0.009% total nitrogen, 0.01 to 0.10% niobium and 0.01 to 0.15% vanadium and/or 0.05 to 0.40% molybdenum with a total content of niobium and carbon of at the most 0.005% and at least 0.004% titanium nitride with a particle size of at the most 0.02 μm, 0 to 0.6% chromium, 0 to 1.0% copper , 0 to 4.0% nickel under the condition $$[(\%\ Cu)+(\%\ Ni)]:5+(\%\ Cr)+(\%\ Mo)\leqq 0.90\%$$

the balance iron, including melt-induced impurities, after an annealing at at the most 1150° C. and subsequent hot rolling with a cross-sectional decrease of at least 50% at a temperature of at the most 930° C. and a final temperature of at the most 830° C., as material for articles which like tubes for artic pipelines must have a high cold toughness.

Although therein 5 mm thick samples of this steel ground 1 mm on both sides were examined for hydrogen cracks after immersion in an H2S solution, it is not possible to deduce from the results of these investigations any conclusions either regarding hydrogen-induced cracking or hydrogen-induced stress crack corrosion in the weld seam region of welded pipes, in particular spiral-seam welded large pipes, because these are obviously samples from the strip.

Figure 1A:
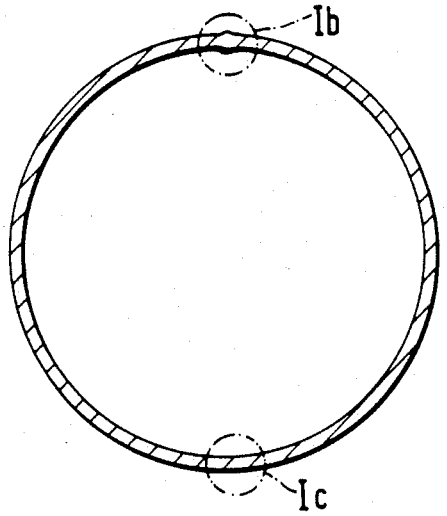

Various standards, for example the US Norm NACE Standard TM-02-84, have been expressly developed for investigating samples taken from welded pipes. In this connection FIG. 1*a* shows a cross-section of a welded pipe from which samples 1, 2 are taken. FIG. 1*b* shows an enlarged view of sample 1 of FIG. 1*a* in cross-section, various crack types being indicated schematically, designated as follows:

I—Cracks along the boundary between basic material and HAZ,

II—HIC similar cracks, SCC cracks in the HAZ in steels still somewhat HIC sensitive, parallel to the surface and in staircase manner through the wall, III—Cracks from the geometrical notch of the seam elevation originating from the pipe wall in Q+T treated pipes and IV Cracks—weakening of grain boundaries by weld heat—along the weld seam in steels of low carbon and niobium content.

"HAZ" means the heat-influenced zone adjacent the weld seam (Heat Affected Zone). HIC flaws can occur in samples without stressing and SCC flaws in samples with stressing.

Figure 1C:
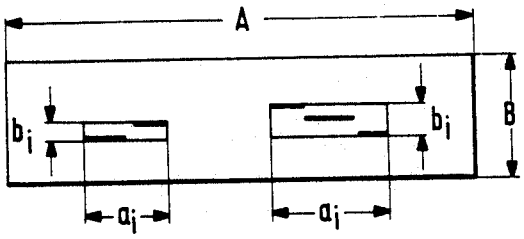

The HIC flaws are defined according to the aforementioned US standards corresponding to the illustration in FIG. 1*c* (sample according to FIG. 1*a*) as CSR—"Crack Sensitivity Ratio", ratio of the cracked area to the sample area in percent, CLR—"Crack Length Ratio", ratio of the crack length to the sample length, CTR—"Crack Transverse Ratio", ratio of the crack width to the sample width in percent, whereby for the so called acidic gas and oil pipes for these types of flaws observation of the following upper limits are required in small samples according to the prior art:

CSR 1.5%
CLR 15%
CTR 5%

If small samples of 100 mm×20 mm x wall thickness of properly made welded tubes are tested they meet the aforementioned requirements. If however entire sample pipe rings are placed in a corrosion solution according to the US Norm NACE TM-01-77 (National Association of Corrosion Engineers), then in accordance with FIG. 1*b* cracks occur in the region of the weld seam. As own investigations have shown, these cracks, in particular in the presence of pearlite rows in the structure, are caused by the high tensile stresses from the welding process. A distinction can be made between the cracks according to the various types I to IV of FIG. 1*b* and they are referred to as SCC (Stress Corrosion Cracking).

The invention is based on the problem of providing a method of the type mentioned at the beginning by means of which the disadvantages of the methods of the prior art are eliminated and welded steel pipes of improved resistance to stress crack corrosion are obtained, i.e. in particular resistance to attack by acidic gases such as hydrogen sulfide, carbonic acid and acidic oils for long-distance pipelines, can be made in simple manner and in addition have good weldability in the field. In particular, the invention is based on the problem of providing a method by means of which the flaws described above in detail in the finished welded pipes for conveying acidic gases and oils are avoided without such a method impairing, i.e. lowering, the mechanical properties, in particular the yield point.

This problem is solved according to the invention by the features set forth in the characterizing clause of claim 1.

An improvement of the steel structure by globular incorporation of the sulfides forming is preferably achieved by adding Ca. Instead of or in addition to the calcium, titanium, zirconium and/or rare earths may be added individually or severally in conventional amounts.

Further advantageous developments of the method according to the invention will be apparent from the subsidiary claims.

Accordingly, the pipe and thus the weld seam is continously heated externally sectionwise with the aid of a medium frequency ring inductor, operated with 0.1 to 5.0 MW, to the necessary temperature of 300° to 680° C., higher by at least 100° C. than the temperature of the inner side, and thereafter cooled with a water or air spray plate, or alternatively only the weld seam region with the immediately adjacent zone is heated externally with the aid of a medium frequency line inductor, operated with 0.5 to 5.0 MW, to a temperature of 300° to 680° C. higher by at least 100° C. compared with the temperature of the inner side and subsequently cooled with water or air jets. In particular cases the heating of the welded strip edges or weld seam can take place autogenously with gas. The essential factors are the control of the mutual influencing of thermal power, treated area and seam feed rate on the one hand and the temperature distribution over the pipe wall depending on thermal conductivity, heat transfer and thermal radiation, as well as the partial heat dissipation with seam feed rate on the other hand. According to the invention this regulation is such that the product of power density in watts per square meter and seam feed rate in meters per second does not fall short of a limit value of 10000 W/(m×sec) with an internally effected partial water or air cooling of 1–2000 liters per meter pipe length.

Further essential to the invention is the use of a steel having a composition according to one or more of claims 1 and 2, which is rolled thermomechanically to a strip, formed to a pipe and welded with longitudinal or spiral seam, and at the inner surface of which compressive inherent stresses are built up, having a pearlitic-ferritic and/or bainitic structure, for the conveying of acidic gases and/or oils; also essential to the invention is the use of a steel made up according to claim 6 treated according to claim 6, the inherent compressive stresses in the inner surface of the pipe being built up across at least a third of the pipe wall thickness as pipes for conveying acidic gases and/or oils.

The advantages of the proposal according to the invention are to be seen in particular in that welded steel pipes, HF-welded or welded under powder with a resistance to stress crack corrosion considerably improved by building up a compressive stress on the side facing the acidic medium of up to 30% of the yield limit using the steels claimed, i.e. in particular resistance to attack by acidic gases and acidic oils, can be made for pipelines which in addition have good weldability in the field and good mechanical properties as well as being technically simple to make.

The invention will be explained in detail hereinafter with reference to preferred examples of embodiment. The drawings represent in FIGS. 1*a* to 1*c* definition and illustration of the crack sizes as explained with regard to the prior art, FIGS. 2*a* to *bb* a schematic illustration of the heat treatment apparatus in two variants, FIG. 3 a schematic illustration of the autogenous heat treatment according to the invention, FIG. 4 flaw types in pipe samples after various heat treatments showing the inherent stresses in the HAZ, FIG. 5 properties of an HF-welded pipe treated according to the invention, FIG. 6 properties of a UP-welded pipe treated according to the invention, FIG. 7 table of steel and pipe data.

A steel which after the tapping is treated by means of a fluorspar slag and flushing with argon in the ladle and thereafter scummed, is further homogenized with calcium in a ladle to obtain preliminary material of highest purity. As in steel desulfurization the steel is tapped slag-free into the basic ladle and after adding a synthetic slag flushed for a few minutes; after adding lump CaSi the flushing treatment is continued.

After this treatment the steel has the following melt analysis:

C—0.09%

Si—0.38%
Mn—0.80%
P—0.010%
S—0.0011%
Al—0.049%
Cu—0.26%
Ni—0.20%
Nb—0.20%
$O_2$—0.002%
N—0.0050%
Ca—0.0014%
the balance iron and unavoidable impurities.

The steel is cast in a continous casting apparatus to slab ingots having dimensions of 200 mm thickness and 1300 mm width and the slabs reheated to a temperature of 1170° to 1250° C. thereafter thermomechanically rolled to a still strip of 11.9 mm thickness and 1300 mm width at a rolling end temperature of 850° to 910° C.

The rolling is carried out in three roughing stands with one pass in the first and second roughing stands and 3 to 5 passes reversibly in the second roughing stand. In the finishing group continuous rolling is carried out on seven stands.

In a spiral pipe mill not shown in the seamed steel strip is formed to a spiral tube having dimensions of 609.6 mm×11.9 mm (API material×60) and the abutting edges of the steel strip connected together by tack welding and the pipe then cut off to a length of for example 18 m. On a separate welding stand the tack-welded pipe is finish welded by double-side under-powder welding. For the welding wires and weld powder of high degree of purity and low hydrogen liberation are used.

From the welded pipes small samples are taken and tested by the HIC test method described above in NACE test solution. In all cases with CLR=6% and CSR=0.5% the usual requirements with CLR=15% and CSR=1.5% were easily fulfilled.

Since the testing of small samples (HIC test methods) and those of pipe rings give of course different results, in particular due to the inherent stresses introduced by the welding, 300 mm long pipe rings were subjected in a large container having the dimensions 850 mm×850 mm×450 mm to hydrogen sulfide in NACE solution with the possibility of the pipe being attacked from the outside and the inside. The surfaces of the test regions, about 100 mm on either side of the weld seam and about 200 mm width opposite the weld seam, were ground in accordance with the HIC test on small samples to exclude any temporary protective influence of the scale. To simulate operating pressure in pipelines with the aid of a linkage stresses were applied in the interior of the pipe. In the region of the weld seam and opposite in the basic material tensile stresses of 44% of the minimum yield point were applied. After 96 hours storing of the pipe rings in the NACE solution they were subjected to ultrasonic examination in the ground regions and then to a metallographic investigation.

The investigation showed in the weld seam transition region to the tube inner side cracks to be regarded as a combination of HIC floors and SCC floors.

In addition to these ring tests in which the NACE solution was able to attack from the inside and the outside, further tests were carried out in which the attack possibility of the solution was only from the inside of the pipe. The stresses for simulating an internal pressure were applied in the same manner as already described, in each case up to 44% of the minimum yield point. Once again, in under-powder-welded pipes, crack systems were detected in the weld seam transition region after 96 hours. Also, cracks occurred in the weld material.

Figure 2A:
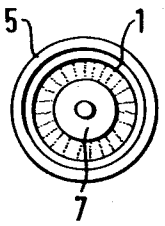

To decrease the inherent stresses assumed to be the cause of the occurrence of the cracks in the weld material and the adjacent heat-affected zones, the pipes were heat treated by means of the apparatus shown in FIG. 2*a*.

FIG. 2*a* shows a spiral-seam-welded pipe 1 which is placed on guide rollers 2 and by means of further guide rollers 3 led past the heat treating apparatus 4 spirally with a speed of 0.4 m to 30 m per minute. The heat treatment apparatus 4 consists firstly of a medium-frequency ring inductor 5 which surrounds the tube 1 over a width of 50 mm annularly with a spacing of 50 mm and is operated with about 0.1 to 5.0 MW for annular heating of the pipe 1 to a temperature of 300° to 680° C. In the interior of the pipe 1 a water or air lance 6 is disposed axially at the head end of which a spray plate 7 is provided spaced 5 to 500 mm from the ring inductor 5, by means of which the peripheral zone of the pipe 1 heated immediately previously by the ring inductor 5 is sprayed with water or air in an amount of 1 to 2000 liters per m pipe and thus cooled.

In FIG. 2*aa* the front view is shown of a medium-frequency ring inductor 5 disposed about the pipe 1 and of the spray plate 7 disposed within the pipe 1 in schematic manner.

Figure 2B:
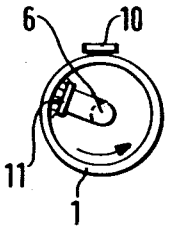
Figure 2A:
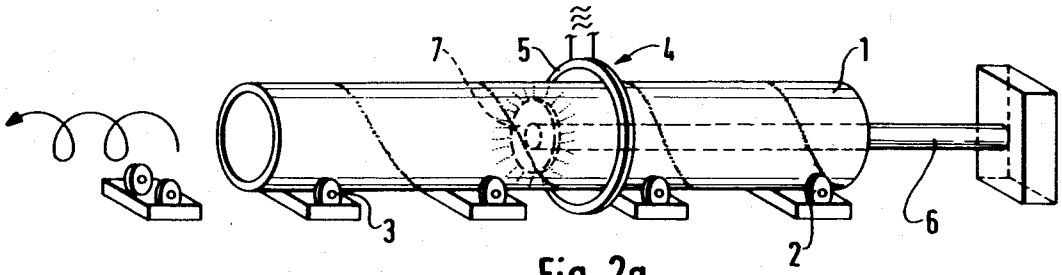
Figure 2B:
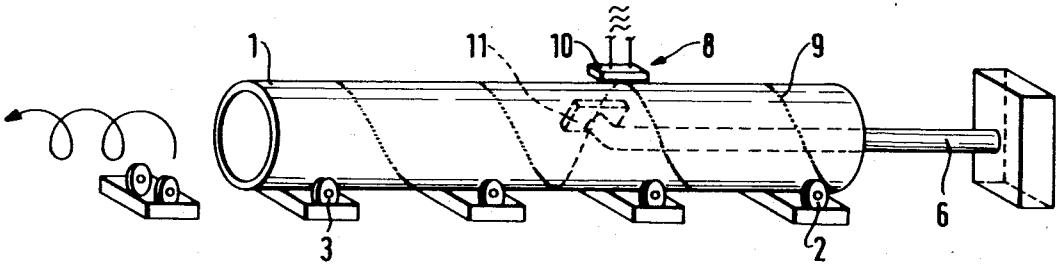

FIG. 2*b* also illustrates a spiral-seam-weld pipe 1 which bears on guide rollers 2 and by means of further guide rollers 3 is led past another heat treatment apparatus 8 following the weld seam 9 with a speed of 0.4 to 30 m per minute. The heat treatment apparatus 8 consists in this case of a medium-frequency line inductor 10—operated with 0.1 to 5.0 MW—having a width of 400 mm past which the weld seam 9 is led, thereby being heated to a temperature of 300° to 680° C. Arranged in the interior of the pipe 1 once again disposed axially within the interior of the pipe 1 is a water or air lance 6 whose end is bent in knee-manner with respect to the pipe inner surface and provided at the end with a nozzle head 11 in a width corresponding substantially to the width of the line inductor 10 for spraying water or air in an amount of 1 to 2000 liters per m pipe onto the tube inner side.

FIG. 2*bb* shows a front view of the pipe 1 with line inductor 10 and bent water or air lance 6 with nozzle head 11.

Figure 3:
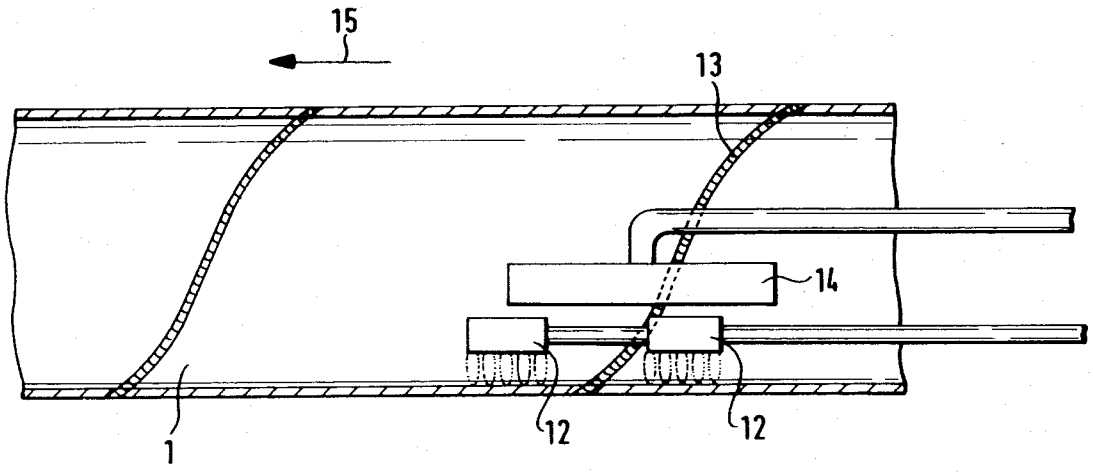

In the same manner as with the ring or line inductor the pipe 1, as shown by FIG. 3, can also be heated autogenously with gas burners 12 on the left and right of the weld seam 13 and thereafter, similarly to FIG. 2*bb*, cooled with a water or air jet means 14. The arrow 15 indicates the feed direction of the pipe 1.

In FIG. 4 the starting state and the values obtained by several methods of the inherent stresses in the pipe interior are represented absolutely related to the yield point of the treated and tested spiral-seam-welded pipes with the dimensions 609.6×11.9 mm of material quality×60 in a bar diagram, and beneath this bar diagram the samples with the crack types occurring associated with the starting state (A) and the methods (B), (D), (E), (H) and (I) are shown schematically. Sections of pipes were tested which were represented and treated as described above. The pipe sections were kept in $H_2S$-saturated solution 96 hours at room temperature. A tensile stress of 44% of the measured yield point (Rp) of the pipe was applied to the pipe interior by ovalizing the pipe section. This starting state is designated in FIG. 4 by A, it being apparent from the associated sample illustration that both in the weld seam and in the heat-affected zone numerous cracks were detected.

In the diagram the bar heights give the longitudinal stress and transverse stress values, measured by the separation or destruction method.

Beneath the bar diagram, for the initial state A and for the various methods B to N important parameters are shown as well as the designation and test results for the respective pipe sections.

The pipes according to D and E were heated to 600° and 700° C. respectively and then cooled externally with water.

Although with this method the inherent or internal stresses are reduced, cracks still occur because on the cooling side (in this case the outside) compressive stresses occur and on the pipe inner side tensile stresses.

The pipes according to F and G, which are heated to 600° C. and thereafter cooled in air, are already crack-free and have a reduced internal or inherent stress. Only the pipes according to H and F which are heated to 640° C. and 700° C. respectively and cooled in air still have cracks.

A method designated Q+T (quench and temper), in which the pipe is heated to 940° or 950° C., quenched with water from the outside and then tempered at 600° or 640° C., also leads to a crack-free sample and a substantial elimination of the inherent or residual stresses.

A building up of the compressive inherent stresses of about 20% of the yield limit in the HAZ on the inner side of the pipe facing the acidic medium does not however take place until methods M and N in which with a water cooling from the inside with 1 to 2000 liters per meter pipe length and a seam feed rate of 0.45 meters per minute maintaining a minimum value of 10000 W/(m×sec) for the product of power density and seam feed rate a temperature of 600° C. on the outer side of the pipe is reached which is at least 100° C. higher than the temperature at the pipe inner side. The tests were carried out with worked-off and non-worked-off seam elevation; in both cases no SCC cracks whatever occur.

The chemical composition of the steel strip, the associated dimensions of the pipe made therefrom, the measured mechanical properties in the starting state and after the annealing and cooling are illustrated together with the corresponding structure patterns in FIG. 5, in this case for a longitudinal seam hf-resistance pressure-welded pipe.

In the same manner as the steel described in FIG. 5 and the above text with its production and treatment, the steel shown in FIG. 6 in detail with the properties determined is suitable for under-powder-welded acidic gas and acidic oil pipes; this applies in the same manner for the steel described in the table of FIG. 7 and the acidic-gas-resistant pipes made therefrom.

We claim:

1. Method of making welded steel pipes which can be used for conveying acidic gas and/or oils, with compressive stresses present on the inner side facing the acidic gas and/or oil, characterized by the combination of the following method steps:

a. provided and thermomechanically rolling a steel having a composition of
0.02 to 0.20% C.
0.10 to 0.60% Si
0.60 to 1.50% Mn
max. 0.02% P
max. 0.005% S
0.01 to 0.16% Al
0.001 to 0.01% Ca,
The ratio Ca: S being greater than 2.25 and the product Ca×S equal to or smaller than 0.001, and depending on the required strength characteristics of the finished steel pipe, at least one alloy elements of the following group:
max. 0.35% CR
max. 1.0% Mo
max. 0.03% B
max. 0.70% Ni or Cu and Ni
max. 0.15% V and/or
max. 0.15% Nb,
the balance iron and unavoidable impurities, forming a strip with pearlitic-ferritic and/or bainitic structure:

b. forming a pipe out of this strip with a ratio of wall thickness to diameter of 1 to 25 to 1 to 160 and welding the strip edges together;

c. and heating the outer side of the welded pipe remote from the acidic oil and/or gas or the weld seam region in max. 400 mm width to a temperature of 300° to 680 degrees C., higher by at least 100 degrees C. than the temperature of the inner side and thereafter cooling from the inside with water or air in an amount of 1 to 2000 liters per meter tube length, with a tube feed in the seam direction during the heating and subsequent cooling of 0.4 to 30 m/min.

2. Method according to claim 1, characterized in providing a steel comprising:
0.02 to 0.04% C.
0.2 to 0.3% Si
0.8 to 1.0% Mn
0.010 to 0.015% B
0.001 to 0.003% S
0.01 to 0.05% Al
0.02 to 0.03% Cu
0.02 to 0.04% Cr
0.02 to 0.03% Ni
the balance iron and unavoidable impurities.

3. Method according to claim 1, characterized in inductively heating the pipe or the weld seam area so that the product of power density and feed rate in the seam direction is not less than 10,000 W/(m x sec).

4. Method according to claim 1, characterized in inductively heating the pipe continuously in sections.

5. Method according to claim 1, characterized in heating the pipe or the weld seam region autogenously with gas so that the product of power density and feed rate in the seam direction is not less than 10,000 W/(m×sec).

6. Method according to claim 1, wherein the steel is rolled thermomechanically to a strip, formed to a pipe and welded with a longitudinal or spiral seam, and at the inner surface of which inherent pressure stresses are built up and which has a pearlitic-ferritic and/or bainitic structure, for the transport of acidic gases and/or oils.

7. Method according to claim 6, wherein the inherent pressure or compressive stresses in the inner surface of the pipe are built up through at least a third of the pipe wall thickness, as in pipes for transporting acidic gases and/or oils.

8. Method according to claim 2, characterized in inductively heating the pipe or the weld seam area so that the product of power density and feed rate in the seam direction is not less than 10,000 W/(m×sec).

9. Method according to claim 2, characterized in inductively heating the pipe continuously in sections.

10. Method according to claim 3, characterized in inductively heating the pipe continuously in sections.

11. Method according to claim 2, characterized in heating the pipe or the weld seam region autogenously with gas so that the product of power density and feed rate in the seam direction is not less than 10,000 W/(m×sec).

12. Method according to claim 8, characterized in inductively heating the pipe continuously in sections.

13. Method according to claim 1, characterized in heating the outerside of the welded pipe remote from the acidic oil and/or gas or the weld seam region in max. 400 mm width to a temperature of 550–650 degrees C., higher by at least 100 degrees C. than the temperature of the inner side.

14. Method according to claim 5, characterized in heating the outer side of the welded pipe remote from the acidic oil and/or gas or the weld seam region in max 400 mm width to a temperature of 550–650 degrees C., higher by at least 100 degrees C. than the temperature of the inner side.

15. Method according to claim 4, characterized in heating the outer side of the welded pipe remote from the acidic oil and/or gas or the weld seam region in max. 400 mm width to a temperature of 550–650 degrees C., higher by at least 100 degrees C. than the temperature of the inner side.

16. Method according to claim 3, characterized in heating the outer side of the welded pipe remote from the acidic oil and/or gas or the weld seam region in max. 400 mm width to a temperature of 550–650 degrees C., higher by at least 100 degrees C. than the temperature of the inner side.

17. Method according to claim 10, characterized in heating the outer side of the welded pipe remote from the acidic oil and/or gas or the weld seam region region in max. 400 mm width to a temperature of 550–650 degrees C., higher by at least 100 degrees C. than the temperature of the inner side.

18. Method according to claim 2, characterized in heating the outer side of the welded pipe remote from the acidic oil and/or gas or the weld seam region in max. 400 mm width to a temperature of 550–650 degrees C., higher by at least 100 degrees C. than the temperature of the inner side.

19. Method according to claim 11, characterized in heating the outer side of the welded pipe remote from the acidic oil and/or gas or the weld seam region in max. 400 mm width to a temperature of 550–650 degrees C., higher by at least 100 degrees C. than the temperature of the inner side.

20. Method according to claim 9, characterized in heating the outer side of the welded pipe remote from the acidic oil and/or gas or the weld seam region in max. 400 mm width to a temperature of 550–650 degrees C., higher by at least 100 degrees C. than the temperature of the inner side.

21. Method according to claim 8, characterized in heating the outer side of the welded pipe remote from the acidic oil and/or gas or the weld seam region in max. 400 m width to a temperature of 550–650 degrees C., higher by at least 100 degrees C. than the temperature of the inner side.

22. Method according to claim 12, characterized in heating the outer side of the welded pipe remote from the acidic oil and/or gas or the weld seam region in max. 400 mm width to a temperature of 550–650 degrees C., higher by at least 100 degrees C. than the temperature of the inner side.

23. Method according to claim 2 wherein the steel is rolledr thermomechanically to a strip, formed to a pipe and welded with a longitudinal or spiral seam, and at the inner surface of which inherent pressure stresses are built up and which has a pearlitic-ferritic and/or bainitic structure, for the transport of acidic gases and/or oils.

24. Method according to claim 23, wherein the inherent pressure of compressive stresses in the inner surface of the pipe are built up through at least a third of the pipe wall thickness, as in pipes for transporting acidic gases and/or oils.

* * * * *